US010705473B2

(12) United States Patent
Kawakami et al.

(10) Patent No.: US 10,705,473 B2
(45) Date of Patent: Jul. 7, 2020

(54) IMAGE FORMING APPARATUS AND CONVEYANCE CONTROL METHOD

(71) Applicant: Konica Minolta, Inc., Chiyoda-ku Tokyo (JP)

(72) Inventors: Yoshiteru Kawakami, Tokyo (JP); Yasuo Shiokawa, Tokyo (JP); Takahiro Okubo, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 178 days.

(21) Appl. No.: 15/889,689

(22) Filed: Feb. 6, 2018

(65) Prior Publication Data

US 2018/0224791 A1 Aug. 9, 2018

(30) Foreign Application Priority Data

Feb. 8, 2017 (JP) ..... 2017-021138

(51) Int. Cl.
*G03G 15/00* (2006.01)
*B65H 7/20* (2006.01)
*B65H 5/06* (2006.01)

(52) U.S. Cl.
CPC ..... *G03G 15/6561* (2013.01); *B65H 5/062* (2013.01); *B65H 7/20* (2013.01); *B65H 2511/22* (2013.01); *B65H 2511/416* (2013.01); *B65H 2515/34* (2013.01); *B65H 2801/06* (2013.01)

(58) Field of Classification Search
CPC ..... G03G 15/6561
USPC ..... 399/396
See application file for complete search history.

(56) References Cited

U.S. PATENT DOCUMENTS 5,428,431 A * 6/1995 Abe ..... G03G 15/165 271/245
5,555,082 A * 9/1996 Tanaka ..... G03G 15/165 271/278
5,602,636 A * 2/1997 Matsuzawa ..... G03G 15/6558 399/388
5,812,923 A * 9/1998 Yamauchi ..... G03G 15/167 399/388
2002/0061214 A1* 5/2002 Miyaki ..... G03G 15/6564 399/396

(Continued)

FOREIGN PATENT DOCUMENTS

JP 2007163854 A 6/2007

OTHER PUBLICATIONS

Chinese Office Action for corresponding CN Patent Application No. 201810109263.4; dated Apr. 26, 2020.

*Primary Examiner* — Anthony H Nguyen
(74) *Attorney, Agent, or Firm* — Cantor Colburn LLP

(57) ABSTRACT

An image forming apparatus includes: a transferer that forms a transfer nip for transferring an image to a sheet; a conveyance roller pair disposed on an upstream side relative to the transfer nip in a conveyance direction of the sheet; and a hardware processor that controls the conveyance roller pair such that the sheet conveyed to a conveyance nip formed by the conveyance roller pair is conveyed with a predetermined nip pressure so as to cause slack in the sheet between the transfer nip and the conveyance nip in which the hardware processor controls the conveyance roller pair so as to reduce the nip pressure at the conveyance nip in accordance with an increase in a conveyance amount of the sheet at the conveyance nip.

18 Claims, 8 Drawing Sheets

(56) References Cited

U.S. PATENT DOCUMENTS

| | | | | |
|---|---|---|---|---|
| 2006/0182477 | A1* | 8/2006 | Takiguchi | G03G 15/6564 399/396 |
| 2009/0324305 | A1* | 12/2009 | Udaka | G03G 15/50 399/302 |
| 2011/0052291 | A1* | 3/2011 | Iwakawa | B65H 5/34 399/388 |
| 2014/0064813 | A1* | 3/2014 | Yoshimura | G03G 15/657 399/388 |

* cited by examiner

Prior Art

IMAGE FORMING APPARATUS AND CONVEYANCE CONTROL METHOD

CROSS REFERENCE TO RELATED APPLICATIONS

The present application claims priority under 35 U.S.C. § 119 to Japanese patent Application No. 2017-021138, filed on Feb. 8, 2017, the entire content of which is incorporated herein by reference.

BACKGROUND

Technological Field

The present invention relates to an image forming apparatus and a conveyance control method.

Description of the Related Art

In general, an electrophotographic image forming apparatus (such as a printer, a copy machine, and a fax machine) is configured to irradiate (expose) a charged photoconductor drum (image bearing member) with (to) laser light based on image data to form an electrostatic latent image on the surface of the photoconductor. The electrostatic latent image is then visualized by supplying toner from a developing device to the photoconductor drum on which the electrostatic latent image is formed, whereby a toner image is formed. Further, the toner image is directly or indirectly transferred to a sheet, and then heat and pressure are applied to the sheet at a fixing nip to form a toner image on the sheet.

A registration roller pair for correcting the positional displacement of a sheet in the width direction is provided on the upstream side of a transfer nip for transferring an image onto a sheet (see, for example, Japanese Patent Application Laid-Open No. 2007-163854), for example. When a sheet is sandwiched by the registration roller pair, the registration roller pair moves the sheet in the width direction before the leading end of the sheet enters the transfer nip so as to correct the position of the sheet in the width direction.

In addition, generally, the sheet conveyance speed at the registration roller pair (the conveyance roller pair on the upstream side of the transfer nip) is higher than the sheet conveyance speed at the transfer nip. With this configuration, as illustrated in FIG. 1A, slack in sheet S is caused in the region between the transfer nip (the portion sandwiched by rollers 423B and 424) and registration roller pair 53*a*.

In a registration transfer area between the transfer nip and the registration roller pair 53*a*, and in a fixation transfer area between the fixing nip and the transfer nip, a difference in conveyance speed resulting from a difference in roller diameter and/or from a difference in alignment is caused. Due to such a difference in conveyance speed, sheet S is pulled in the registration transfer area and/or the fixation transfer area, causing image defects. In view of this, the image defects are suppressed by causing slack in sheet S in the registration transfer area and the like, and/or by controlling the conveyance speed at the fixing nip (the portion sandwiched by rollers 63 and 64) to cause slack in sheet S in the fixation transfer area.

SUMMARY

However, when the conveyance speed is increased at registration roller pair 53*a* to a speed higher than a desired conveyance speed due to a difference in roller diameter and/or to abrasion of the roller, the slack amount of sheet S is undesirably increased in the registration transfer area in some situation.

Consequently, when the rear end of sheet S passes registration roller pair 53*a*, and/or when registration roller pair 53*a* is separated during conveyance of sheet S, the returning amount of sheet S might be increased as illustrated in FIG. 1B, and image defects such as a shock noise might be caused in the transfer nip.

Such image defects tend to be caused particularly in a configuration in which the sandwiching force of sheet S is small at the secondary transfer nip. In addition, in the case where an image is formed on a long sheet having a sheet length greater than that of an A3 sheet, the difference in sheet conveyance amount between the secondary transfer nip and registration roller pair 53*a* is increased with an increase in the entire conveyance amount, thus significantly causing of the image defects.

An object of the present invention is to provide an image forming apparatus and a conveyance control method that can suppress image defects at the transfer nip due to slack in a sheet between the transfer nip and the conveyance roller pair.

To achieve the abovementioned object, an image forming apparatus reflecting one aspect of the embodiment of the present invention includes: a transferer that forms a transfer nip for transferring an image to a sheet; a conveyance roller pair disposed on an upstream side relative to the transfer nip in a conveyance direction of the sheet; and a hardware processor that controls the conveyance roller pair such that the sheet conveyed to a conveyance nip formed by the conveyance roller pair is conveyed with a predetermined nip pressure so as to cause slack in the sheet between the transfer nip and the conveyance nip, in which the hardware processor controls the conveyance roller pair so as to reduce the nip pressure at the conveyance nip in accordance with an increase in a conveyance amount of the sheet at the conveyance nip.

To achieve the abovementioned object, a conveyance control method reflecting one aspect of the embodiment of the present invention is a method of an image forming apparatus, the image forming apparatus including: a transferer that forms a transfer nip for transferring an image to a sheet; and a conveyance roller pair disposed on an upstream side relative to the transfer nip in a conveyance direction of the sheet, the method including: controlling the conveyance roller pair such that the sheet conveyed to a conveyance nip formed by the conveyance roller pair is conveyed with a predetermined nip pressure so as to cause slack in the sheet between the transfer nip and the conveyance nip, and controlling the conveyance roller pair so as to reduce the nip pressure at the conveyance nip in accordance with an increase in a conveyance amount of the sheet at the conveyance nip.

BRIEF DESCRIPTION OF DRAWINGS

The advantages and features provided by one or more embodiments of the invention will become more fully understood from the detailed description given hereinbelow and the appended drawings which are given by way of illustration only, and thus are not intended as a definition of the limits of the embodiment of the present invention.

DETAILED DESCRIPTION OF EMBODIMENTS

Figure 1A:
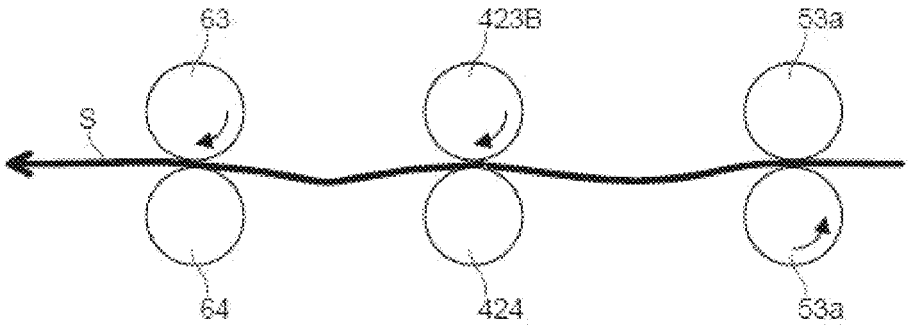
FIG. 1A Prior Art
FIG. 1A and FIG. 1B illustrate a sheet conveyed between a transfer nip and a registration roller pair.

Hereinafter, one or more embodiments of the present invention will be described by referring to the drawings. However, the scope of the invention is not limited to the disclosed embodiments.

Figure 2:
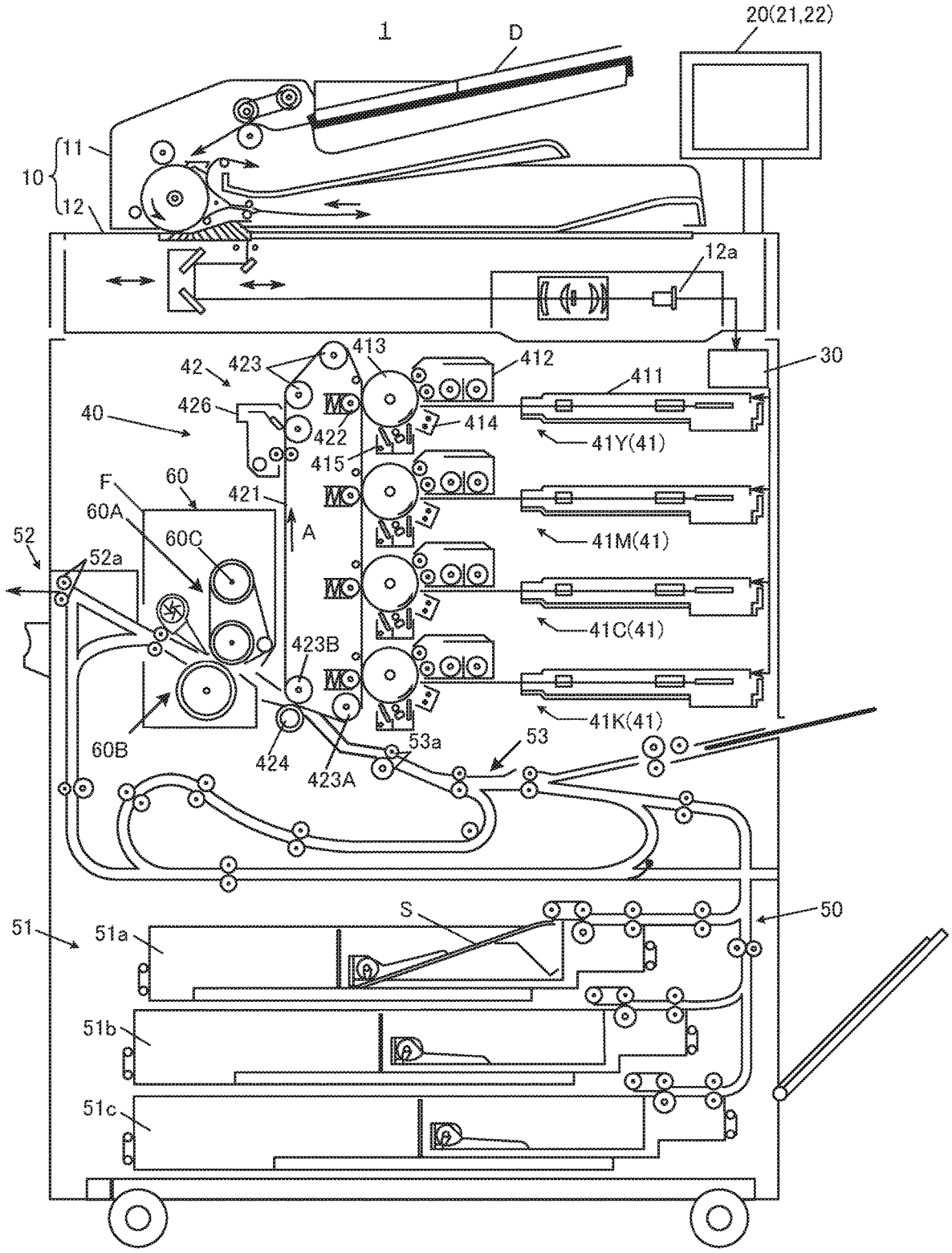
FIG. 2 schematically illustrates a general configuration of an image forming apparatus of the embodiment.
Figure 3:
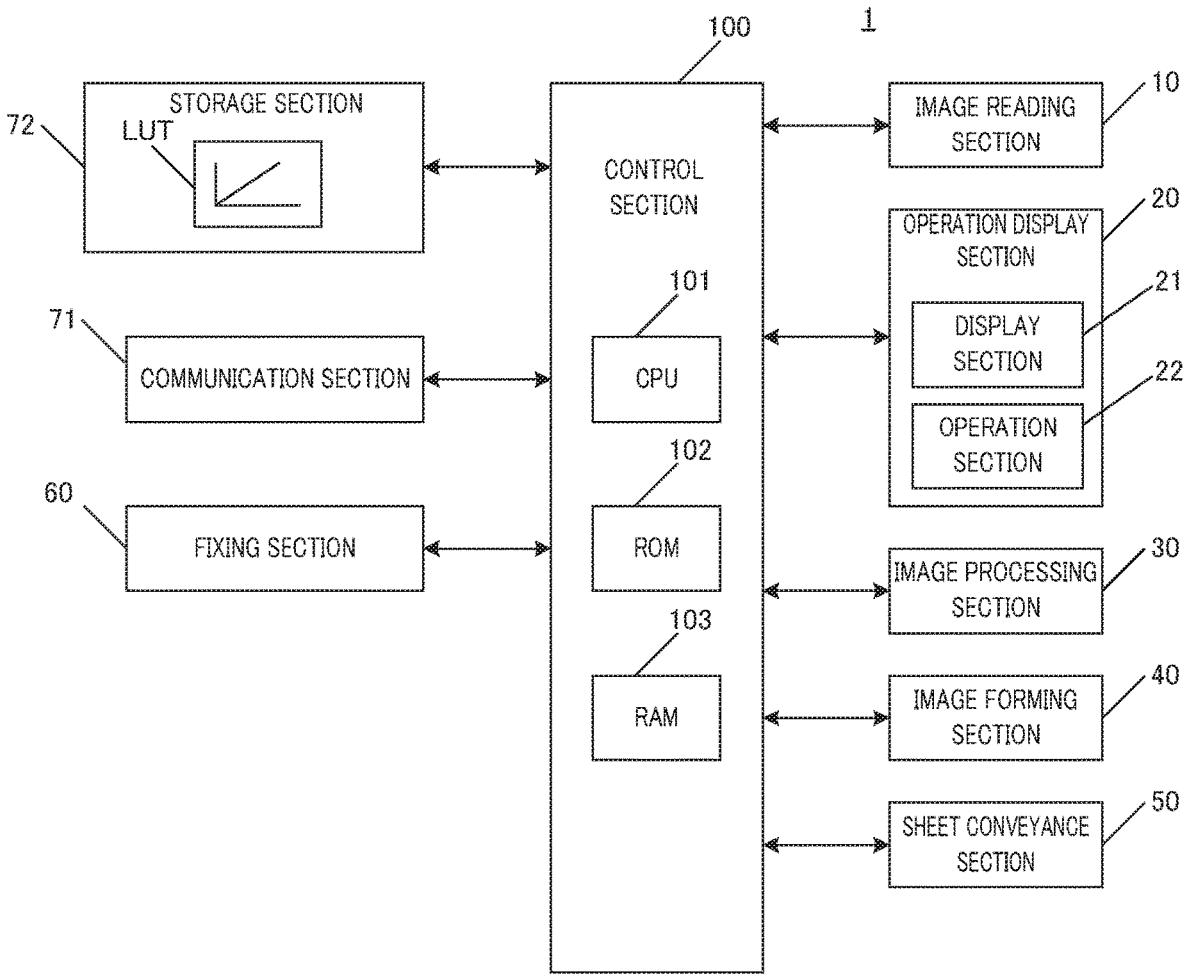
FIG. 3 illustrates a principal part of a control system of the image forming apparatus of the embodiment.

In the following, the present embodiment is described in detail with reference to the drawings. FIG. 2 illustrates an overall configuration of image forming apparatus 1 according to the present embodiment. FIG. 3 illustrates a principal part of a control system of image forming apparatus 1 according to the embodiment.

Image forming apparatus 1 of the present embodiment uses a long sheet or a non-long sheet as sheet S, and forms an image on sheet S.

In the present embodiment, a long sheet is a flat sheet that is longer in the conveyance direction than generally used A4 sheets, A3 sheets and the like, and has a length that cannot be stored in sheet tray units 51*a* to 51*c* in the apparatus. In the following description, the "sheet" includes a long sheet and a non-long sheet.

Image forming apparatus 1 is a color-image forming apparatus of an intermediate transfer system using electrophotographic process technology. That is, image forming apparatus 1 transfers (primary-transfers) toner images of yellow (Y), magenta (M), cyan (C), and black (K) formed on photoconductor drums 413 to intermediate transfer belt 421, and superimposes the toner images of the four colors on one another on intermediate transfer belt 421. Then, image forming apparatus 1 secondary-transfers the resultant image to a sheet, thereby forming a toner image.

A tandem system is adopted for image forming apparatus 1. In the tandem system, photoconductor drums 413 corresponding to the four colors of YMCK are placed in series in the travelling direction of intermediate transfer belt 421, and the toner images of the four colors are sequentially transferred to intermediate transfer belt 421 in one cycle.

As illustrated in FIG. 3, image forming apparatus 1 includes image reading section 10, operation display section 20, image processing section 30, image forming section 40, sheet conveyance section 50, fixing section 60, control section 100 and the like.

Control section 100 includes central processing unit (CPU) 101, read only memory (ROM) 102, random access memory (RAM) 103 and the like. CPU 101 reads a program suited to processing contents out of ROM 102, develops the program in RAM 103, and integrally controls an operation of each block of image forming apparatus 1 in cooperation with the developed program. At this time, CPU 101 refers to various kinds of data stored in storage section 72.

Control section 100 transmits and receives various data to and from an external apparatus (for example, a personal computer) connected to a communication network such as a local area network (LAN) or a wide area network (WAN), through communication section 71. Control section 100 receives, for example, image data transmitted from the external apparatus, and operates to form a toner image on a sheet based on the image data (input image data).

Image reading section 10 includes auto document feeder (ADF) 11, document image scanning device 12 (scanner), and the like.

Auto document feeder 11 causes a conveyance mechanism to feed document D placed on a document tray, and sends out document D to document image scanner 12. Auto document feeder 11 enables images (even both sides thereof) of a large number of documents D placed on the document tray to be successively read at once.

Document image scanner 12 optically scans a document fed from auto document feeder 11 to its contact glass or a document placed on its contact glass, and brings light reflected from the document into an image on the light receiving surface of charge coupled device (CCD) sensor 12*a*, to thereby read the document image. Image reading section 10 generates input image data on the basis of a reading result provided by document image scanner 12. Image processing section 30 performs predetermined image processing on the input image data.

Operation display section 20 includes, for example, a liquid crystal display (LCD) provided with a touch panel, and functions as display section 21 and operation section 22. Display section 21 displays various operation screens, image statuses, operating conditions of each function, and the like in accordance with display control signals received from control section 100. Operation section 22 includes various operation keys such as numeric keys and a start key, receives various input operations performed by a user, and outputs operation signals to control section 100.

Image processing section 30 includes a circuit that performs a digital image process suited to initial settings or user settings on the input image data, and the like. For example, image processing section 30 performs tone correction on the basis of tone correction data (tone correction table LUT) in storage section 72, under the control of control section 100. In addition to the tone correction, image processing section 30 also performs various correction processes such as color correction and shading correction as well as a compression process, on the input image data. Image forming section 40 is controlled on the basis of the image data that has been subjected to these processes.

Image forming section 40 includes: image forming units 41Y, 41M, 41C, and 41K that form images of colored toners of a Y component, an M component, a C component, and a K component on the basis of the input image data; intermediate transfer unit 42; and the like.

Image forming units 41Y, 41M, 41C, and 41K for the Y component, the M component, the C component, and the K component have similar configurations. For ease of illustration and description, common elements are denoted by the same reference signs. Only when elements need to be discriminated from one another, Y, M, C, or K is added to their reference signs. In FIG. 2, reference signs are given to only the elements of image forming unit 41Y for the Y component, and reference signs are omitted for the elements of other image forming units 41M, 41C, and 41K.

Image forming unit 41 includes exposing device 411, developing device 412, photoconductor drum 413, charging device 414, drum cleaning device 415 and the like.

Photoconductor drum 413 is a negative-charging type organic photoconductor (OPC) having photoconductivity in which an undercoat layer (UCL), a charge generation layer (CGL), and charge transport layer (CTL) are sequentially stacked on a peripheral surface of a conductive cylindrical body made of aluminum (aluminum raw pipe), for example.

Control section 100 controls a driving current supplied to a driving motor (not shown in the drawings) that rotates photoconductor drums 413, whereby photoconductor drums 413 is rotated at a constant circumferential speed (linear speed).

Charging device 414 evenly negatively charges the surface of photoconductor drum 413. Exposure device 411 is composed of, for example, a semiconductor laser, and configured to irradiate photoconductor drum 413 with laser light corresponding to the image of each color component. Thus, an electrostatic latent image of each color component is formed on the surface of photoconductor drum 413 by the potential difference from its surroundings.

Developing device 412 is, for example, a two-component development type developing device, and attaches the toners of respective color components to the surface of photoconductor drums 413 to visualize the electrostatic latent image, thereby forming a toner image.

Drum cleaning device 415 includes a cleaning member configured to be brought into sliding contact with the surface of photoconductor drum 413, and the like. With a cleaning blade, drum cleaning device 415 removes transfer residual toner remaining on the surface of photoconductor drum 413 after the primary transfer.

Intermediate transfer unit 42 includes intermediate transfer belt 421, primary transfer roller 422, a plurality of support rollers 423, secondary transfer roller 424, belt cleaning device 426 and the like.

Intermediate transfer belt 421 is composed of an endless belt, and is stretched around the plurality of support rollers 423 in a loop form. At least one of the plurality of support rollers 423 is composed of a driving roller, and the others are each composed of a driven roller. Preferably, for example, roller 423A disposed on the downstream side in the belt travelling direction relative to primary transfer rollers 422 for K-component is a driving roller. With this configuration, the travelling speed of the belt at a primary transfer section can be easily maintained at a constant speed. When driving roller 423A rotates, intermediate transfer belt 421 travels in arrow A direction at a constant speed.

Primary transfer rollers 422 are disposed on the inner periphery side of intermediate transfer belt 421 to face photoconductor drums 413 of respective color components. Primary transfer rollers 422 are brought into pressure contact with photoconductor drums 413 with intermediate transfer belt 421 therebetween, whereby a primary transfer nip for transferring a toner image from photoconductor drums 413 to intermediate transfer belt 421 is formed.

Secondary transfer roller 424 is disposed to face backup roller 423B disposed on the downstream side in the belt travelling direction relative to driving roller 423A, at a position on the outer peripheral surface side of intermediate transfer belt 421. Secondary transfer roller 424 is brought into pressure contact with backup roller 423B with intermediate transfer belt 421 therebetween, whereby a secondary transfer nip for transferring a toner image from intermediate transfer belt 421 to sheet S is formed.

Intermediate transfer belt 421, backup roller 423B and secondary transfer roller 424 correspond to the "transfer section" of the embodiment of the present invention. The secondary transfer nip corresponds to the "transfer nip" of the embodiment of the present invention.

When intermediate transfer belt 421 passes through the primary transfer nip, the toner images on photoconductor drums 413 are sequentially primary-transferred to intermediate transfer belt 421. To be more specific, a primary transfer bias is applied to primary transfer rollers 422, and an electric charge of the polarity opposite to the polarity of the toner is applied to the side that makes contact with primary transfer rollers 422 of intermediate transfer belt 421, whereby the toner image is electrostatically transferred to intermediate transfer belt 421.

Thereafter, when the sheet passes through the secondary transfer nip, the toner image on intermediate transfer belt 421 is secondary-transferred to the sheet. To be more specific, a secondary transfer bias is applied to secondary transfer roller 424, and an electric charge opposite to that of the toner is applied to the side of the sheet that makes contact with secondary transfer roller 424, whereby the toner image is electrostatically transferred to the sheet. The sheet on which the toner image has been transferred is conveyed toward fixing section 60.

Belt cleaning device 426 includes a belt cleaning blade configured to make sliding contact with the surface of intermediate transfer belt 421, and the like, and removes transfer residual toner remaining on the surface of intermediate transfer belt 421 after the secondary transfer.

Fixing section 60 includes upper fixing section 60A having a fixing side member disposed on a fixing surface side of a sheet, lower fixing section 60B having a back side supporting member disposed on the side opposite to the fixing surface of the sheet, heating source 60C, and the like. The back side supporting member is brought into pressure contact with the fixing side member, whereby a fixing nip for conveying a sheet in a tightly sandwiching manner is formed.

At the fixing nip, fixing section 60 applies heat and pressure to a sheet on which a toner image has been secondary-transferred to fix the toner image on the sheet. Fixing section 60 is disposed as a unit in fixing part F.

Sheet conveyance section 50 includes sheet feeding section 51, sheet ejection section 52, conveyance path section 53 and the like. Three sheet feed tray units 51*a* to 51*c* included in sheet feeding section 51 store sheets S (standard sheets, special sheets) discriminated on the basis of the basis weight (rigidity), the size, and the like, for each type set in advance. Conveyance path section 53 includes a plurality of conveyance rollers such as registration roller pair 53*a* and the like, and a duplex conveyance path for forming images on both sides of a sheet, and the like. Registration roller pair 53*a* corresponds to the "conveyance roller pair" of the embodiment of the present invention.

Under the control of control section 100, registration roller pair 53*a* corrects the position of sheet S in the width direction. To be more specific, when sheet S is sandwiched by registration roller pair 53*a*, registration roller pair 53*a* moves in the width direction to move sheet S before the leading end of the sheet enters the secondary transfer nip, whereby the position of sheet S in the width direction is corrected.

At a timing after correcting the position of sheet S in the width direction and before the sheet S passes registration roller pair 53*a*, that is, during conveyance of the sheet S, registration roller pair 53*a* is separated and moved back to the former position. Then, after the rear end of sheet S has passed through registration roller pair 53*a*, registration roller pair 53*a* is reset to the pressure contact state. It is to be noted that registration roller pair 53*a* may be kept in the pressure contact state during the conveyance of sheet S.

In addition, under the control of control section 100, the conveyance speed of sheet S at registration roller pair 53*a* is set to a speed higher than the conveyance speed of sheet S at the secondary transfer nip formed by backup roller 423B and secondary transfer roller 424.

Specifically, the registration nip formed by registration roller pair 53*a* is controlled to convey sheet S with a predetermined nip pressure. The predetermined nip pressure is a nip pressure at which, at the conveyance speeds set at registration roller pair 53*a* and the secondary transfer nip, the conveyance amount of sheet S at the registration nip is greater than that at the secondary transfer nip. The registration nip corresponds to the "conveyance nip" of the embodiment of the present invention.

With this configuration, the conveyance amount of sheet S at the registration nip is greater than that at the secondary transfer nip, and slack in sheet S is caused in the region between the secondary transfer nip and registration roller pair 53*a* (hereinafter referred to as "registration transfer area").

In the registration transfer area, and in the region between the fixing nip and the secondary transfer nip (hereinafter referred to as "fixation transfer area"), there are a difference in conveyance speed resulting from a difference in roller diameter, and/or from a difference in alignment. Due to such a difference in conveyance speed, sheet S is pulled in the registration transfer area and/or the fixation transfer area, resulting in image defects. In view of this, such image defects are suppressed by causing slack in sheet S in the registration transfer area, and/or by causing slack in sheet S in the fixation transfer area by controlling the conveyance speed at fixing section 60.

In addition, in the case where the conveyance speed at fixing section 60 is controlled so as to cause slack in sheet S in the fixation transfer area, it is preferable to provide a detection section for detecting slack in sheet S in the fixation transfer area.

Sheets S stored in sheet tray units 51*a* to 51*c* are output one by one from the uppermost, and conveyed to image forming section 40 by conveyance path section 53. At this time, registration roller pair 53*a* corrects the skew of the fed sheet S and adjusts the conveyance timing.

Then, in image forming section 40, the toner image on intermediate transfer belt 421 is secondary-transferred to one side of sheet S at one time, and a fixing process is performed in fixing section 60. Sheet S on which an image has been formed is ejected out of the image forming apparatus by sheet ejection section 52 including sheet ejection rollers 52*a*.

Incidentally, when the conveyance speed is increased to a speed higher than a desired conveyance speed due to a difference in roller diameter and/or abrasion of the roller, the slack amount of sheet S in the registration transfer area might be undesirably increased.

Figure 1B:
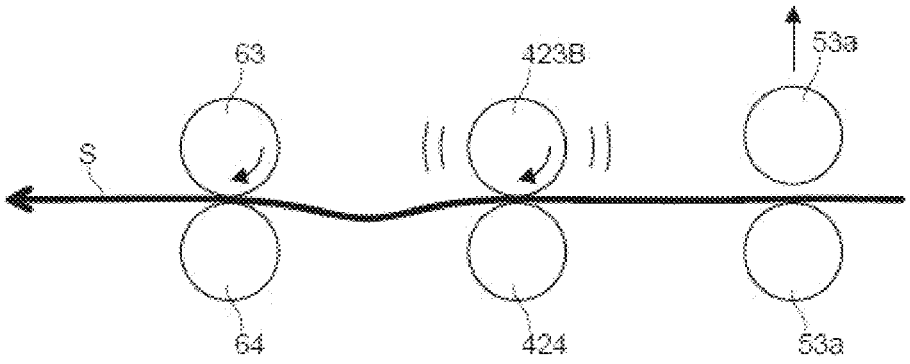

Therefore, when the rear end of sheet S passes the registration nip, and/or when registration roller pair 53*a* is separated during conveyance of sheet S, the returning amount of sheet S might be increased as illustrated in FIG. 1B, and consequently image defects such as shock noise might be caused in the transfer nip.

Such image defects tend to be caused particularly in a configuration in which the sandwiching force of sheet S in the secondary transfer nip is small. In addition, in the case where an image is formed on a long sheet having a sheet length greater than that of an A3 sheet, the difference in sheet conveyance amount between the transfer nip and the registration nip is increased with an increase in the entire conveyance amount increases, thus significantly causing the above-mentioned image defects.

Figure 4:
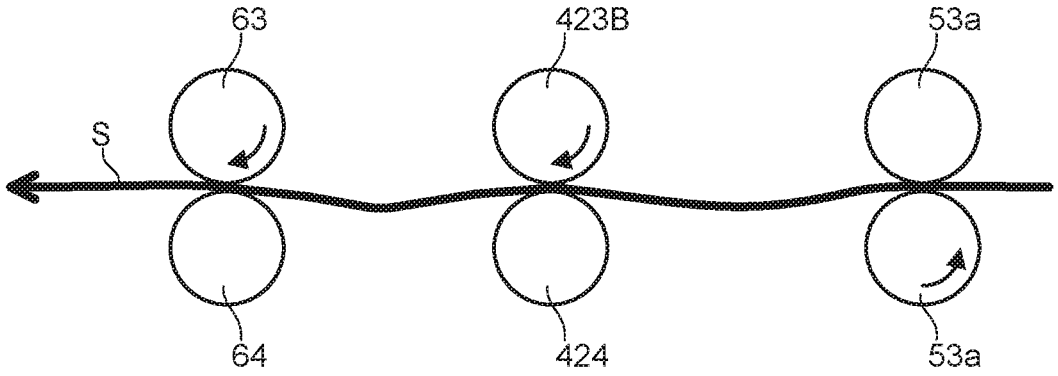
FIG. 4 illustrates a sheet conveyed between a secondary transfer nip and a registration roller pair before a nip pressure is changed.
Figure 5:
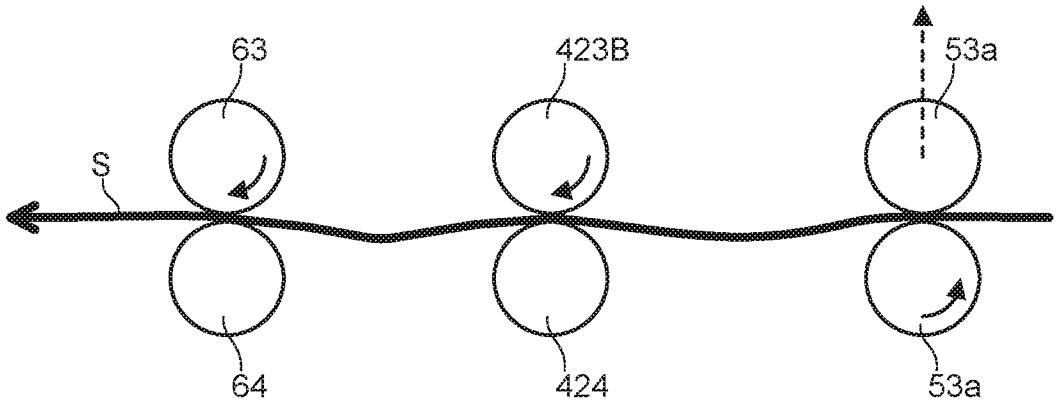
FIG. 5 illustrates a sheet conveyed between the secondary transfer nip and the registration roller pair after the nip pressure is changed.

In view of this, in the present embodiment, control section 100 controls registration roller pair 53*a* such that the nip pressure at the registration nip is gradually reduced from the predetermined nip pressure in accordance with the increase of the conveyance amount of sheet S at the registration nip as illustrated in FIG. 4 and FIG. 5.

Specifically, as illustrated in FIG. 4, until the conveyance amount of sheet S at the registration nip becomes a predetermined conveyance amount, sheet S is conveyed in the state where the nip pressure at the registration nip is kept at the predetermined nip pressure under the control of control section 100. When the conveyance amount of sheet S at the registration nip becomes the predetermined conveyance amount, sheet S is conveyed in the state where the nip pressure at the registration nip is reduced under the control of control section 100 as illustrated in FIG. 5.

For example, the predetermined conveyance amount is a conveyance amount corresponding to a slack amount of sheet S which does not cause image defects due to the slack in sheet S, and may be appropriately changed by a space in the registration transfer area of image forming apparatus 1. It is to be noted that the predetermined conveyance amount can be appropriately set in accordance with the type of sheet S and the like in consideration that the slack amount of sheet S which might cause image defects differs depending on the type of sheet S.

In addition, the examples of the control of reducing the nip pressure include a control of changing the pressure contact amount registration roller pair 53*a* by controlling a cam not illustrated for establishing the pressure contact state of registration roller pair 53*a* and the like. That is, control section 100 moves the rollers of registration roller pair 53*a* away from each other (see the broken arrow in FIG. 5) to thereby reduce the nip pressure at the registration nip.

With this configuration, the conveyance amount of sheet S at the registration nip is gradually reduced, and thus slack in sheet S in the registration transfer area is not excessively increased, and the state at the start of the control is maintained. Accordingly, the image defects at the secondary transfer nip due to slack in sheet S in the registration transfer area can be suppressed.

Figure 6:
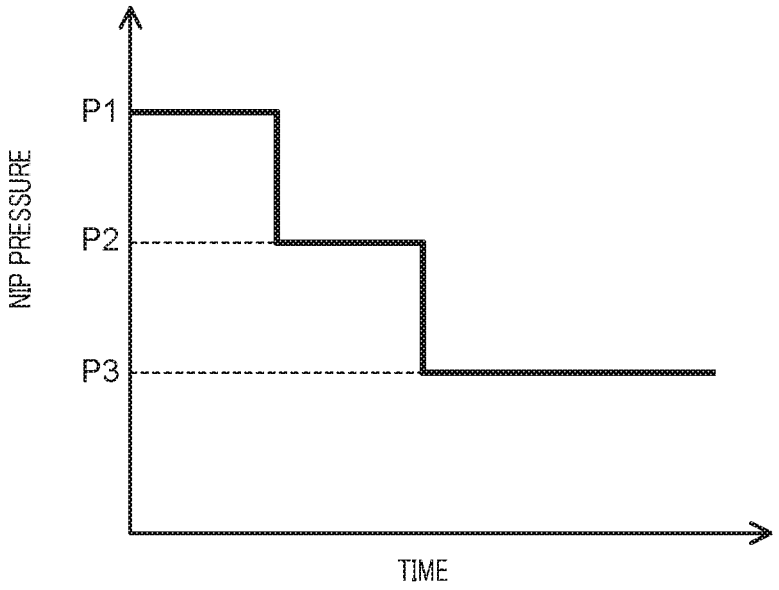
FIG. 6 illustrates a temporal variation of the nip pressure.

In addition, as illustrated in FIG. 6, control section 100 may reduce the nip pressure at the registration nip in a stepwise manner. FIG. 6 illustrates an example case where the nip pressure is changed from P1, which is a predetermined nip pressure, to P2, which is a nip pressure lower than P1 by one level, and then to P3, which is a nip pressure lower than P2 by one level.

Figure 7:
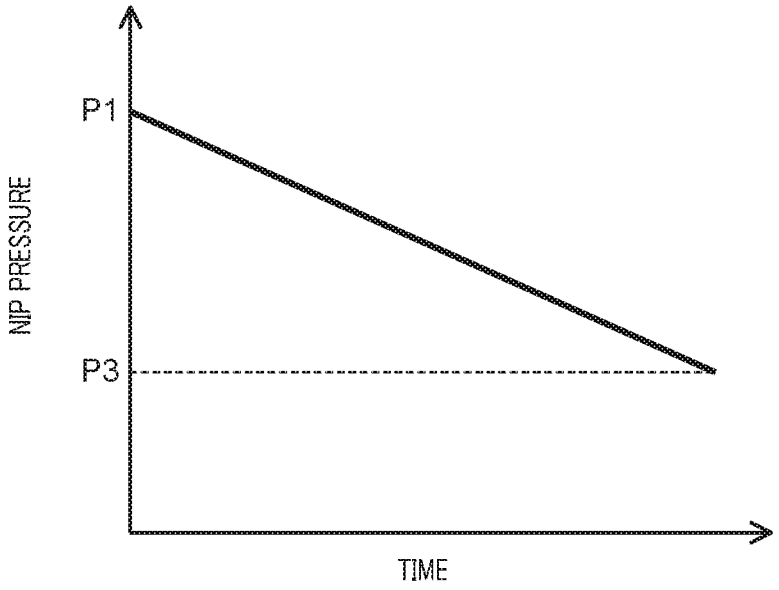
FIG. 7 illustrates a temporal variation of the nip pressure.

In addition, as illustrated in FIG. 7, control section 100 may continuously reduce the nip pressure at the registration nip. FIG. 7 illustrates an example case where the nip pressure is linearly reduced from P1, which is a predetermined nip pressure, to P3.

Figure 8:
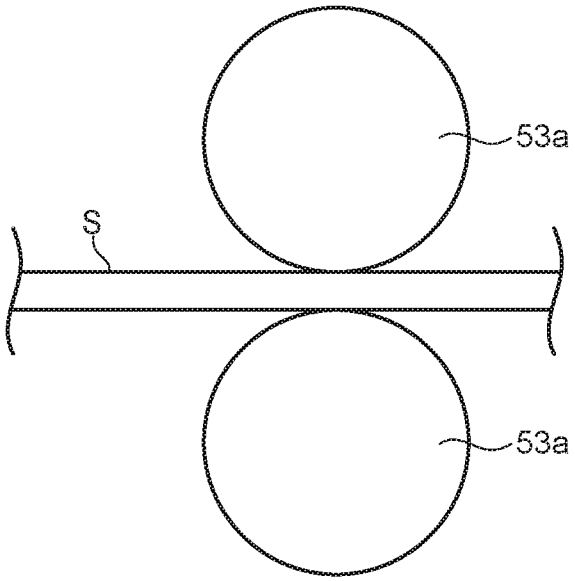
FIG. 8 illustrates a thin sheet conveyed at the registration roller pair.

In addition, control section 100 may determine the reducing amount of the nip pressure at the registration nip in accordance with the basis weight of sheet S. As illustrated in FIG. 8, in the case where sheet S is a thin sheet having a small basis weight, when the rollers of registration roller pair 53*a* are separated from each other by a certain distance, the nip pressure required for conveyance of sheet S might not be ensured. Therefore, in the case where sheet S is a thin sheet having a small basis weight is used, control section 100 sets the reducing amount of the nip pressure at the registration nip to a small value.

Figure 9:
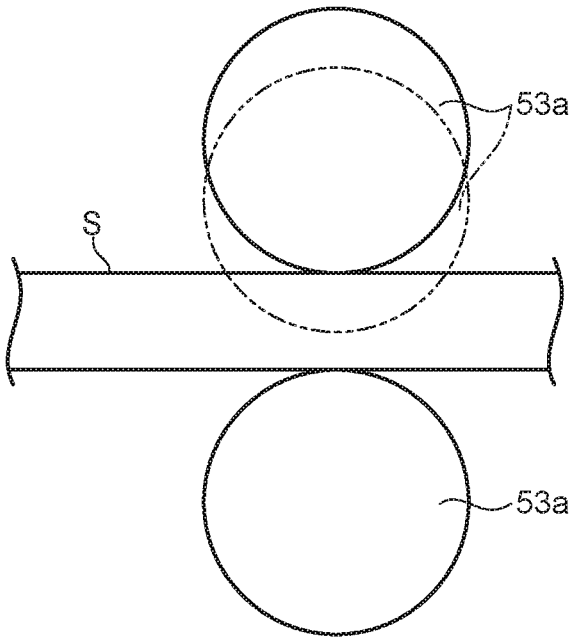
FIG. 9 illustrates a thick sheet conveyed at the registration roller pair.

In contrast, in the case where a thick sheet having a large basis weight of sheet S is used as illustrated in FIG. 9, even when the rollers of registration roller pair 53*a* are separated from each other by a certain distance, the nip pressure required for conveyance of sheet S can be easily ensured. Therefore, in the case where a thick sheet having a large basis weight of sheet S is used, control section 100 sets the reducing amount of the nip pressure at the registration nip to a large value. In the case of sheet S illustrated in FIG. 9, the distance between the rollers are long so that the nip pressure at the registration nip is small in comparison with the case of a thin sheet (indicated with the chain double-dashed line in the drawing).

In addition, control section 100 may determine the reducing amount of the nip pressure at the registration nip in accordance with the type of sheet S. For example, in the case where sheet S is a coated sheet provided with a surface coating, the surface is easily slip in comparison with a plain sheet provided with no surface coating, and therefore a certain nip pressure is required in conveyance of sheet S.

Therefore, in the case where a coated sheet is used, control section 100 sets the reducing amount of the nip pressure at the registration nip to a value smaller than the case where a plain sheet is used. With this configuration, in the case where a coated sheet is used, slip of sheet S at the registration nip can be reduced.

Incidentally, in duplex printing, an image is formed on a first surface (for example, the front surface) of sheet S and then an image is formed on a second surface opposite to the first surface (for example, the rear surface). While there is no image on the surface at the time of image formation on the first surface, an image has been formed on the first surface at the time of image formation on the second surface.

Consequently, the slipping amount at the registration nip differs between image formation on the first surface and the image formation on the second surface. To be more specific, in the case where an image has been formed on sheet S, slip at the registration nip is easily caused in comparison with the case where no image has been formed, and therefore it is necessary to ensure a certain nip pressure at the time of image formation on the second surface in duplex printing.

In view of this, in the case where an image is formed on the second surface of sheet S after an image is formed on the first surface of sheet S, control section 100 sets different values between the reducing amount of the nip pressure at the registration nip for the image formation on the first surface, and the reducing amount at the registration nip for the image formation on the second surface. To be more specific, control section 100 sets the reducing amount such that the reducing amount of the nip pressure of the registration nip for the image formation on the first surface is greater than the reducing amount of the nip pressure of the registration nip for the image formation on the second surface. In this manner, in the image formation on the second surface, a nip pressure greater than that of the image formation on the first surface can be ensured, whereby slip of sheet S at the registration nip can be reduced.

In addition, in duplex printing, the reducing amount of the nip pressure at the registration nip for the image formation on the second surface may be determined in accordance with the coverage of the image of the first surface. The greater the image coverage, the more easily sheet S slips at the registration nip. Therefore, by performing a control in which the reducing amount of the nip pressure at the registration nip is reduced as the coverage of the image increases, slip of sheet S at the registration nip can be further suppressed.

In addition, after the nip pressure at the registration nip is reduced and sheet S passes registration roller pair 53*a*, registration roller pair 53*a* is required to be reset to the pressure contact state so that the nip pressure at the registration nip becomes the predetermined nip pressure as soon as possible for the position correction of the next sheet S and the conveyance of the next sheet S to the secondary transfer nip.

In view of this, control section 100 sets the speed of resetting registration roller pair 53*a* to the pressure contact state, to a speed smaller than the speed of reducing the nip pressure at the registration nip. In this manner, the preparation for the position correction and the conveyance of the next sheet S can be quickly made.

Figure 10:
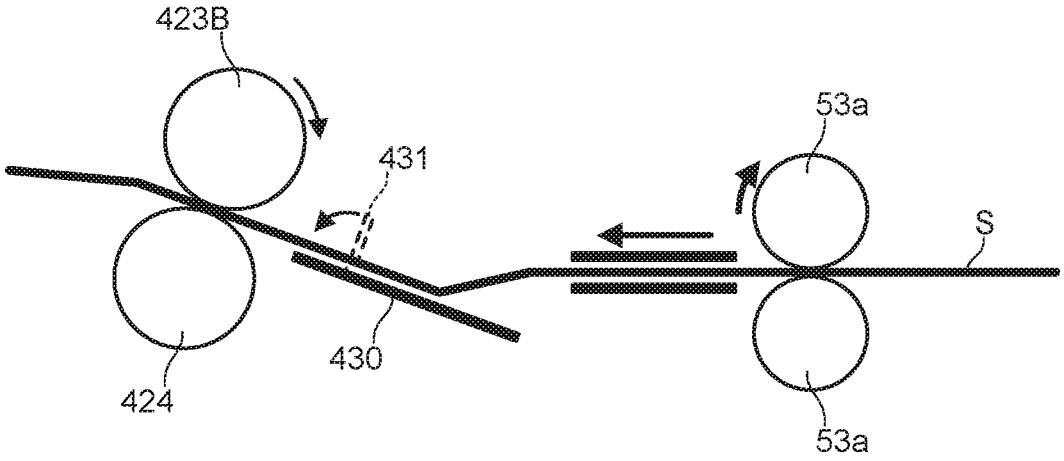
FIG. 10 illustrates a slack detection section provided on an upper side of a guide member.

In addition, as illustrated in FIG. 10, for example, when slack detection section 431 that detects slack in sheet S is provided in guide member 430 provided on the upstream side of the secondary transfer nip, it is possible to perform the control of reducing the nip pressure at the registration nip based on the detection result of slack detection section 431.

In the case where slack detection section 431 is an actuator that can sway in the conveyance direction of sheet S on the upper side of guide member 430 for example, slack detection section 431 detects slack in sheet S by detecting the angle to guide member 430.

With this configuration, the control can be performed in accordance with the actual slack amount in sheet S. That is, it is possible to perform a control in which, when the slack amount of sheet S decreases, the nip pressure is increased to increase the slack amount of sheet S, whereas when the slack amount of sheet S increases, the nip pressure is reduced to reduce the slack amount of sheet S.

As a result, it is possible to maintain appropriate slack in the registration transfer area. In addition, it is possible to change the timing of the control of reducing the nip pressure at the registration nip in accordance with the actual slack amount.

In addition, control section 100 changes the timing of the control of reducing the nip pressure at the registration nip in accordance with the type and/or the basis weight of sheet S. To be more specific, in the case where sheet S is a thin sheet, the timing is delayed since the stiffness of a thin sheet is low and image defects are not easily caused even with large slack. In the case where sheet S is a thick sheet, the timing is advanced since the stiffness of a thick sheet is high and image defects are caused when large slack is caused. With this configuration, the control can be performed at an appropriate timing in accordance with the type and/or the basis weight of sheet S.

Figure 11:
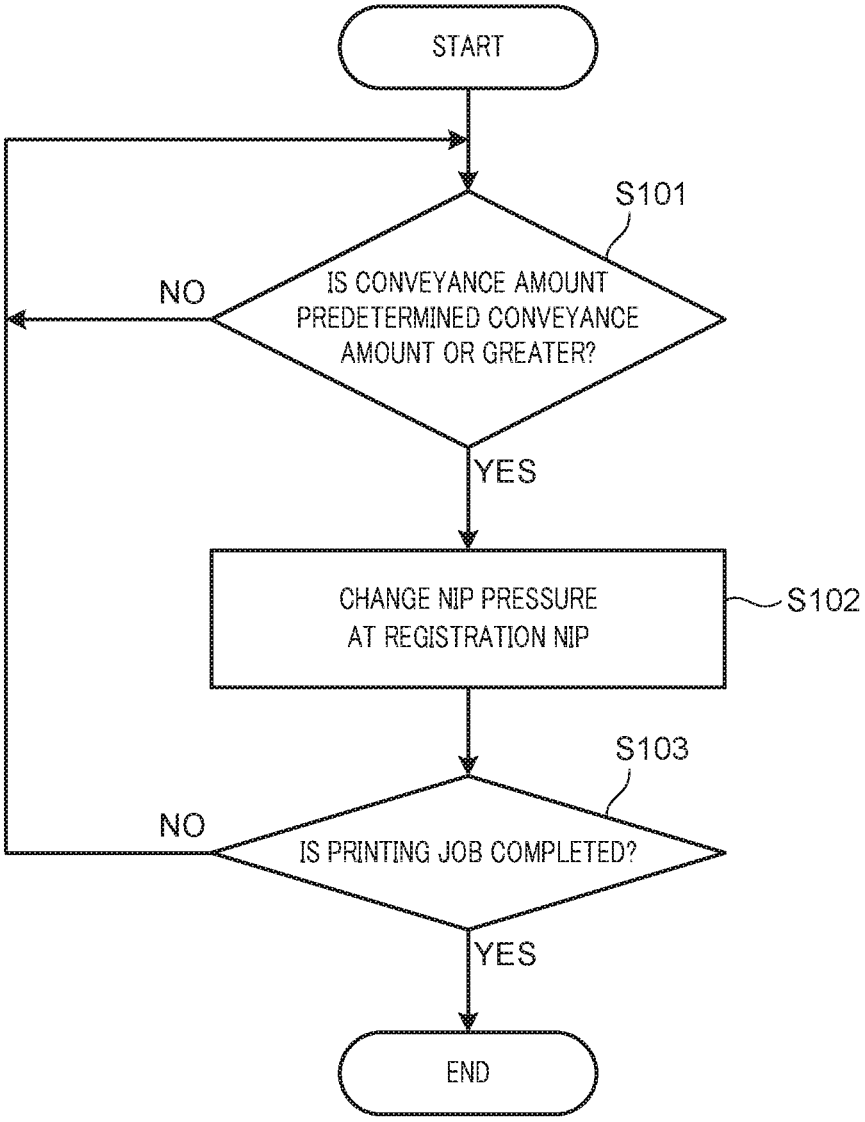
FIG. 11 is a flowchart of an exemplary operation of a conveyance control in the image forming apparatus.

Now an exemplary operation of a nip pressure control in image forming apparatus 1 having the above-mentioned configuration is described. FIG. 11 is a flowchart of an exemplary operation of a nip pressure control in image forming apparatus 1. The processes in FIG. 11 are appropriately executed in a printing job. It is to be noted that the processes in FIG. 11 are examples of a control in the case where sheet S is a long sheet.

As illustrated in FIG. 11, control section 100 determines whether the conveyance amount of sheet S is not smaller than a predetermined conveyance amount (step S101). When it is determined that the conveyance amount of sheet S is smaller than the predetermined conveyance amount (NO at step S101), the process of step S101 is repeated.

When the conveyance amount of sheet S is not smaller than the predetermined conveyance amount (YES at step S101), control section 100 changes the nip pressure at the registration nip (step S102). To be more specific, control section 100 changes the nip pressure at the registration nip so as to reduce the nip pressure.

Next, control section 100 determines whether the printing job is completed (step S103). When it is determined that the printing job is not completed (No at step S103), the process is returned to step S101. When the printing job is completed (YES at step S103), the control is completed.

According to the present embodiment including the above-mentioned configuration, the conveyance amount of sheet S at the registration nip is gradually reduced, and thus slack in sheet S in the registration transfer area is not excessively increased, whereby the state at the start of the control is maintained. Accordingly, the image defects at the secondary transfer nip due to slack in sheet S in the registration transfer area can be suppressed.

In addition, with this configuration, the conveyance amount of sheet S at the registration nip can be reduced with respect to the secondary transfer nip by adjusting the nip pressure at the registration nip in view of the fact that the above-mentioned image defects tend to be caused particularly in a configuration in which the sandwiching force of sheet S at the secondary transfer nip is small. As a result, even with the configuration in which the sandwiching force of sheet S at the secondary transfer nip is small, the image defects at the secondary transfer nip due to slack in sheet S in the registration transfer area can be suppressed.

In addition, in the case where sheet S is a long sheet, the nip pressure at the registration nip is reduced during conveyance, whereby slack in sheet S in the registration transfer area is not excessively increased. Accordingly, the image defects at the secondary transfer nip due to slack in sheet S in the registration transfer area can be suppressed.

It is to be noted that, in the process of reducing the nip pressure, the rollers of registration roller pair 53*a* may be separated as long as image defects due to slack in sheet S are not caused in the registration transfer area.

The embodiments disclosed herein are merely exemplifications and should not be considered as limitative. While the invention made by the present inventor has been specifically described based on the preferred embodiments, it is not intended to limit the present invention to the above-mentioned preferred embodiments but the present invention may be further modified within the scope and spirit of the invention defined by the appended claims.

Although embodiments of the embodiment of the present invention have been described and illustrated in detail, the disclosed embodiments are made for purposes of illustration and example only and not limitation. The scope of the embodiment of the present invention should be interpreted by terms of the appended claims.

What is claimed is:

1. An image forming apparatus comprising:

a transferrer that forms a transfer nip for transferring an image to a sheet;

a conveyance roller pair disposed on an upstream side relative to the transfer nip in a conveyance direction of the sheet; and a hardware processor that controls the conveyance roller pair such that the sheet conveyed to a conveyance nip formed by the conveyance roller pair is conveyed with a predetermined nip pressure so as to cause slack in the sheet between the transfer nip and the conveyance nip, wherein the hardware processor controls the conveyance roller pair so as to reduce the nip pressure at the conveyance nip in accordance with an increase in a conveyance amount of the sheet at the conveyance nip such that the conveyance roller pair conveys the sheet in the state where the nip pressure is reduced.

2. The image forming apparatus according to claim 1, wherein the hardware processor starts to reduce the nip pressure at the conveyance nip after the conveyance amount of the sheet at the conveyance nip reaches a predetermined conveyance amount.

3. The image forming apparatus according to claim 1, wherein the hardware processor reduces the nip pressure at the conveyance nip in a stepwise manner.

4. The image forming apparatus according to claim 1, wherein the hardware processor reduces the nip pressure at the conveyance nip in a continuous manner.

5. The image forming apparatus according to claim 1, wherein the hardware processor reduces the nip pressure at the conveyance nip by moving rollers of the conveyance roller pair away from each other.

6. The image forming apparatus according to claim 1, wherein the hardware processor determines a reducing amount of the nip pressure at the conveyance nip in accordance with a type of the sheet.

7. The image forming apparatus according to claim 1, wherein the hardware processor determines a reducing amount of the nip pressure at the conveyance nip in accordance with a basis weight of the sheet.

8. The image forming apparatus according to claim 1, wherein, when forming an image on a second surface of the sheet after forming an image on a first surface opposite to the second surface, the hardware processor sets the reducing amount such that the reducing amount of the nip pressure at the conveyance nip for the image formation on the first surface and the reducing amount of the nip pressure at the conveyance nip for the image formation on the second surface are different from each other.

9. The image forming apparatus according to claim 8, wherein the hardware processor sets the reducing amount such that the reducing amount of the nip pressure at the conveyance nip for the image formation on the first surface is larger than the reducing amount of the nip pressure at the conveyance nip for the image formation on the second surface.

10. The image forming apparatus according to claim 8, wherein the hardware processor determines the reducing amount of the nip pressure at the conveyance nip for the image formation on the second surface in accordance with a coverage of the first surface.

11. The image forming apparatus according to claim 1, wherein the hardware processor resets the conveyance roller pair to a pressure contact state such that, after the sheet passes the conveyance nip, the predetermined nip pressure is set before a next sheet is conveyed to a position of the conveyance nip; and sets a speed of resetting the conveyance roller pair to the pressure contact state to a speed higher than a speed of reducing the nip pressure at the conveyance nip.

12. The image forming apparatus according to claim 1 further comprising:

a slack detector that detects slack in the sheet between the transfer nip and the conveyance nip, wherein the hardware processor performs a control of reducing the nip pressure at the conveyance nip based on a detection result of the slack detector.

13. The image forming apparatus according to claim 1, wherein the hardware processor changes a timing of a control of reducing the nip pressure at the conveyance nip in accordance with a type of the sheet.

14. The image forming apparatus according to claim 1, wherein the hardware processor changes a timing of a control of reducing the nip pressure at the conveyance nip in accordance with a basis weight of the sheet.

15. The image forming apparatus according to claim 1, wherein the conveyance roller pair is a registration roller pair that moves in a width direction of the sheet to correct a position of the sheet being conveyed.

16. A conveyance control method of an image forming apparatus, the image forming apparatus including:

a transferrer that forms a transfer nip for transferring an image to a sheet; and a conveyance roller pair disposed on an upstream side relative to the transfer nip in a conveyance direction of the sheet, the method comprising:

controlling the conveyance roller pair such that the sheet conveyed to a conveyance nip formed by the conveyance roller pair is conveyed with a predetermined nip pressure so as to cause slack in the sheet between the transfer nip and the conveyance nip, and controlling the conveyance roller pair so as to reduce the nip pressure at the conveyance nip in accordance with an increase in a conveyance amount of the sheet at the conveyance nip such that the conveyance roller pair conveys the sheet in the state where the nip pressure is reduced.

17. The image forming apparatus according to claim 1, wherein the nip pressure is reduced at the conveyance nip to a reduced nip pressure via one or more intermediate nip pressures between the predetermined nip pressure and the reduced nip pressure.

18. The conveyance control method according to claim 16, wherein the nip pressure is reduced at the conveyance nip to a reduced nip pressure via one or more intermediate nip pressures between the predetermined nip pressure and the reduced nip pressure.

* * * * *